US008764110B2

(12) United States Patent
Hsuan-Chin

(10) Patent No.: US 8,764,110 B2
(45) Date of Patent: Jul. 1, 2014

(54) RESILIENT LEANING POSITION-RESTORING DEVICE FOR HEIGHT-ADJUSTABLE CHAIR BACK OF OFFICE CHAIR

(75) Inventor: Tsai Hsuan-Chin, Chai-Yi Hsien (TW)

(73) Assignee: Fuh Shyan Co., Ltd., Chia-Yi Hsien (TW)

( * ) Notice: Subject to any disclaimer, the term of this patent is extended or adjusted under 35 U.S.C. 154(b) by 336 days.

(21) Appl. No.: 13/184,608

(22) Filed: Jul. 18, 2011

(65) Prior Publication Data

US 2013/0020849 A1 Jan. 24, 2013

(51) Int. Cl.
*A47C 7/44* (2006.01)

(52) U.S. Cl.
CPC ..... *A47C 7/44* (2013.01)
USPC ..... 297/291; 297/353; 297/298; 297/284.7

(58) Field of Classification Search
CPC ..... A47C 7/44
USPC ..... 297/300.2, 285, 291, 284.4, 284.7, 298, 297/353; D6/334–336, 364–367
See application file for complete search history.

(56) References Cited

U.S. PATENT DOCUMENTS 3,294,442 A * 12/1966 Fliut ..... 297/298
5,624,158 A * 4/1997 Adat et al. ..... 297/230.14
6,419,318 B1 * 7/2002 Albright ..... 297/284.7
6,609,755 B2 * 8/2003 Koepke et al. ..... 297/300.2
8,272,691 B2 * 9/2012 Hsuan-Chin ..... 297/285
2008/0179929 A1 * 7/2008 Beyer et al. ..... 297/284.4

FOREIGN PATENT DOCUMENTS

CN 201641146 U 11/2010

* cited by examiner

*Primary Examiner* — Anthony D Barfield

(74) *Attorney, Agent, or Firm* — Alan Kamrath; Kamrath IP Lawfirm, P.A.

(57) ABSTRACT

A resilient leaning position-restoring device for a height-adjustable chair back of an office chair includes a back support unit, a height-adjustable chair back disposed on the back support unit, and a resilient leaning position-restoring device disposed between the back support unit and the chair back. The resilient leaning position-restoring device essentially includes a sliding element slidable along a slot disposed on the back support unit and being pulled downward by a spring. The upper end of the sliding element extends to form a resilient member of an inverted U shape. A lower end of the resilient member is coupled to the chair back. The resilient member maintains the predetermined resilience thereof for supporting the bottom of the chair back while height adjustment of the chair back is underway. The bottom of the chair back lends proper support to the sitter's waist, regardless of an adjusted position of the chair back.

2 Claims, 7 Drawing Sheets

RESILIENT LEANING POSITION-RESTORING DEVICE FOR HEIGHT-ADJUSTABLE CHAIR BACK OF OFFICE CHAIR

BACKGROUND OF THE INVENTION

1. Field of the Invention

The present invention relates to a resilient leaning position-restoring device slidably disposed on the back support unit and characterized by resilient retraction. The resilient leaning position-restoring device comprises a resilient member coupled to the bottom of a chair back, such that resilient support given by the resilient member to the bottom of the chair back remains unaffected while the chair back is undergoing height adjustment thereof.

2. Description of the Prior Art

Office workers today stay at the office more often than at home, and thus, comfortable office chairs play an important role. However, a sitting posture that remains unchanged for a long period of time causes waist pain and back pain. The benefits of commercially available protective waistcoats designed for preventing waist pain and back pain are still unproven. Excessive customer loyalty to the protective waistcoats may not benefit the customers themselves. The sedentary life of computer users are susceptible to waist pain and back pain, and, thus, computer users need appropriate office chairs.

In general, the stress sustained by lumbar intervertebral discs is greater in a sitting posture with an upright trunk or with a trunk that inclines forward slightly (in a manner that the included angle between the trunk and the thighs is less than 90°) than it is in a standing posture. Hence, a sedentary posture (deficient in variation of posture) is likely to cause fatigue. As a result, after sitting for a long while, human beings move their bodies to relieve discomfort. In this regard, a chair back of a chair bears a portion of the body weight of a person sitting in the chair. Thus, the chair back reduces the person's lumbar stress, thereby allowing the person to relax his or her muscles. Hence, it is important for human beings to reduce waist pain, back pain, and fatigue when at work by enabling the waist to receive as much support from the chair back as possible. In case of a low seat of a chair, the lumbar vertebrae of a person sitting in the chair fail to come into contact with the chair back and thus fail to receive support therefrom. Likewise, if the chair back is too high or too low, the lumbar vertebrae of a person sitting in the chair cannot receive proper support from the chair back.

In view of this, a lumbar resilient leaning position-restoring device was developed for a height-adjustable chair back of an office chair of CN201641146. The resilient leaning position-restoring device essentially comprises a resilient support unit characterized by a resilient extension and retraction function and pivotally connected between the lower end of a height-adjustable chair back and the chair proper. The resilient support unit comprises a supporting inner rod and a supporting outer rod which are engaged with each other and can be resiliently retracted by a spring disposed therebetween. Springs are inserted and positioned at two pivotal ends of the resilient support unit for allowing the resilient support unit and the chair back to move in a predetermined direction. Hence, not only is the height of the chair back adjustable, but a person sitting in the chair can resiliently lean against the lower lumbar portion of the chair back. The resilient leaning position-restoring device not only allows sitters of different stature to lean against the chair back ergonomically, but also gives comfortable support to the sitters' waist and relieves the waist pain and back pain typical of a sedentary life.

However, to enable the chair back to descend and restore its position automatically, a spring is disposed between the support unit and the chair back for pulling the chair back downward and maintaining a force for pulling the chair back downward at any time. The above-mentioned has a drawback. That is, the bottom of the chair back retracts backward. Hence, it is necessary to provide another spring for not only offsetting the backward retraction of the chair back but also providing the resilient support for the sitters' waist. Hence, the structure in its entirety is not only intricate, but the two springs vary in resilience at the cost of the resilience of each other. Even if the chair back is ascending, the bottom of the chair back will retract slightly. Thus, there is inadequate resilient support for the sitters' waist, thereby greatly reducing the resilient support initially given to the sitters' waist and preventing better anticipated effect from being attained.

BRIEF SUMMARY OF THE INVENTION

To solve the aforesaid problem with an opposite variation of resilient support in the course of the adjustment of height and position of a conventional chair back, the present invention provides a resilient leaning position-restoring device disposed between the back support unit and the bottom of the chair back, such that the original lumbar resilience support of the chair back remains unaffected and intact after the adjustment of height and position of the chair back.

The present invention solves the aforesaid technical problems by providing a chair back slidable along a back support unit and thus capable of height adjustment. A resilient leaning position-restoring device is disposed between the bottom of the chair back and the back support unit. The resilient leaning position-restoring device comprises a sliding element and a resilient member. The sliding element is pulled downward by a spring to slide along the back support unit. The resilient member is extended from the upper end of the sliding element and has a lower end coupled to the bottom of the chair back.

As disclosed in the aforesaid solution, a slot is disposed at a lower portion of the back support unit and covered with a lid, and the sliding element is held between the lid and the slot. The upper end and the lower end of the spring are fixed to the upper end of the sliding element and the lower end of the slot, respectively. The resilient member extended from the sliding element is of an inverted U shape.

The beneficial effects of the present invention are: in the course of the adjustment of the height of the chair back as effectuated by the resilient leaning position-restoring device, not only does a spring keep pulling the chair back downward, but the resilient member enables the lower lumbar portion of the chair back to always maintain the predetermined resilience thereof for giving proper support to the sitters' waist, regardless of a height at which the chair back is adjustably positioned.

BRIEF DESCRIPTION OF THE SEVERAL VIEWS OF THE DRAWINGS

The present invention is further described hereunder with embodiments and the accompanying drawings below.

DETAILED DESCRIPTION OF THE EMBODIMENTS OF THE INVENTION

Figure 1:
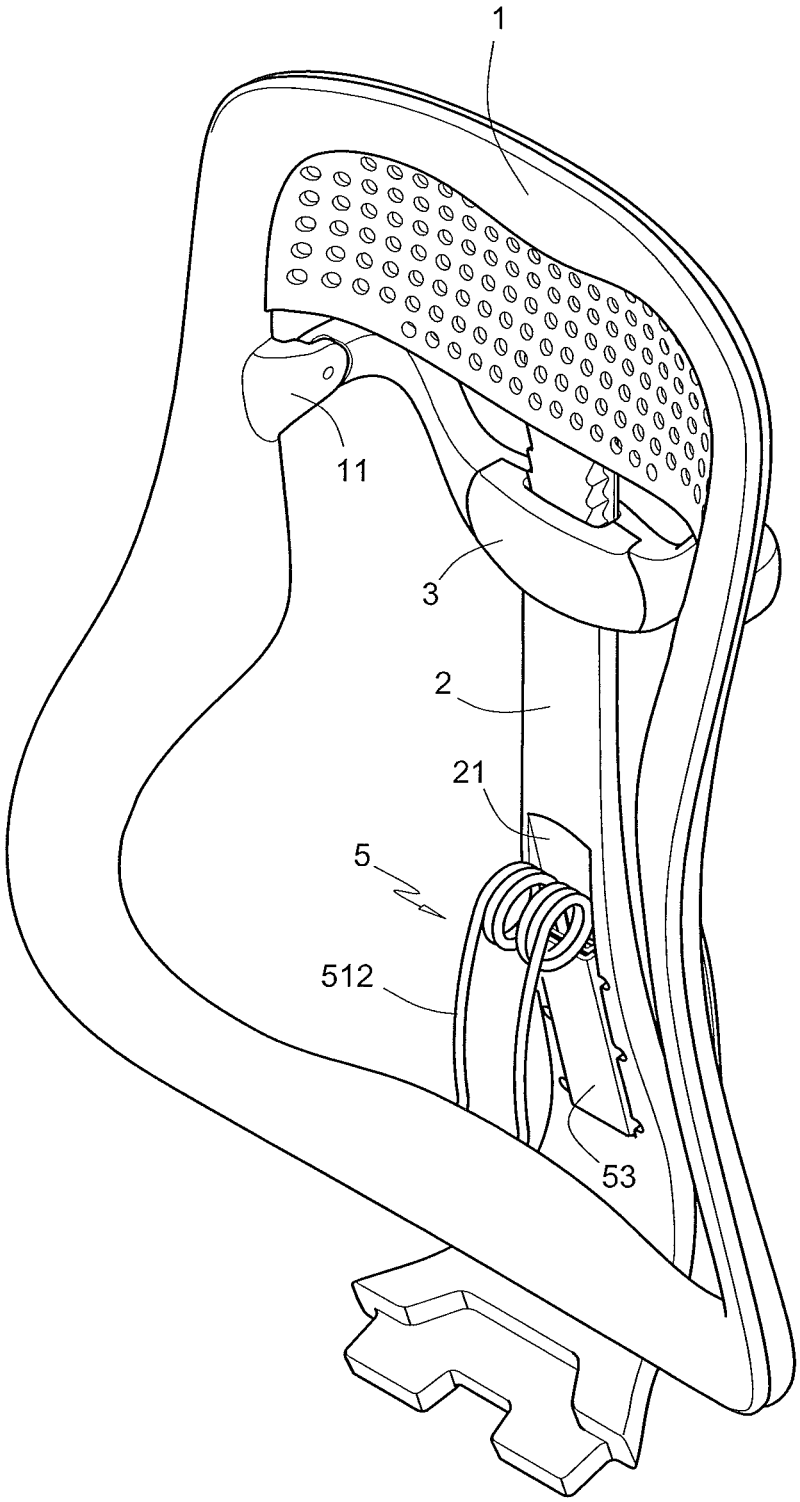
FIG. 1 is a perspective assembled schematic view of the present invention.
Figure 2:
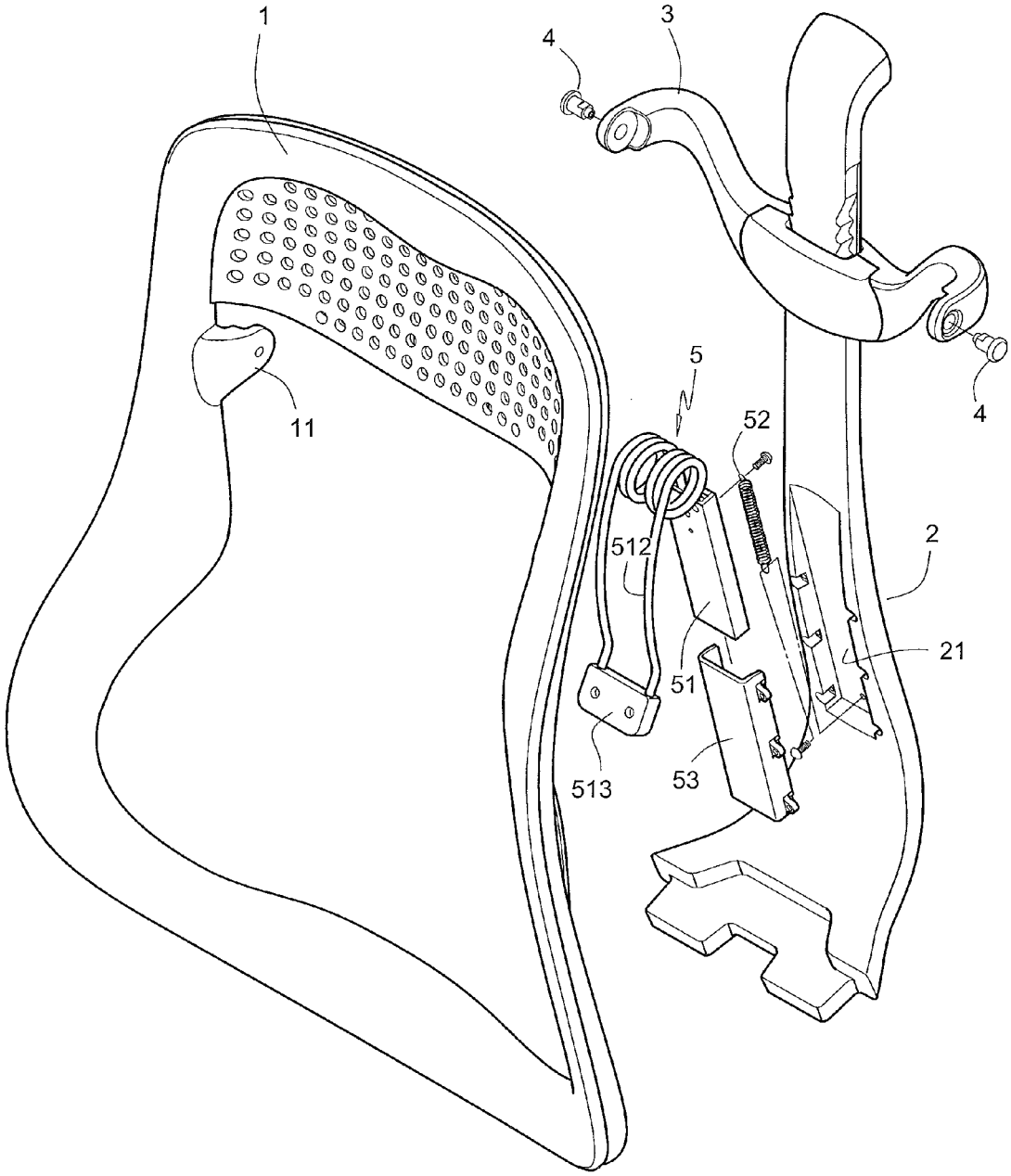
FIG. 2 is a first perspective exploded schematic view of the present invention.
Figure 3:
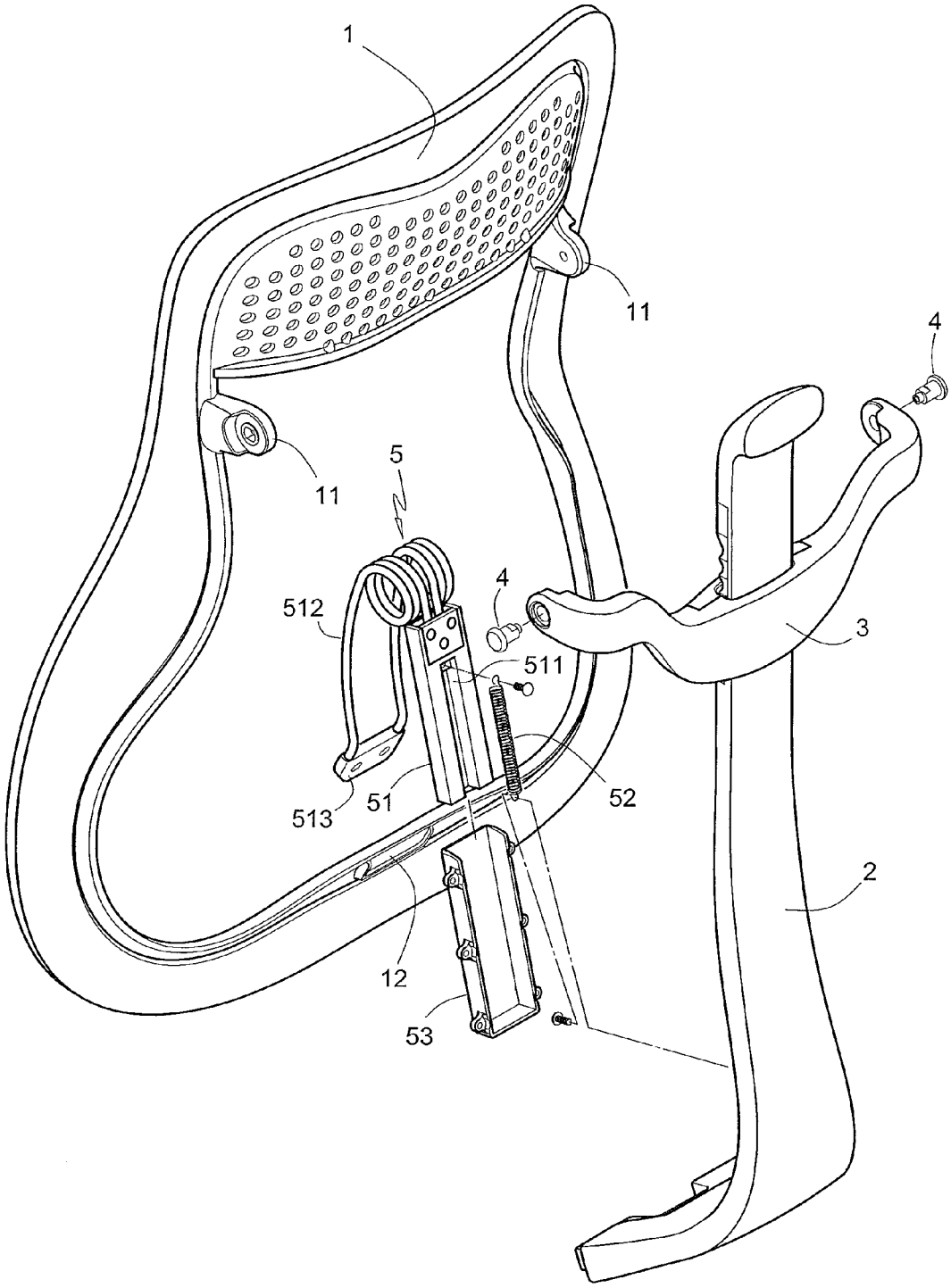
FIG. 3 is a second perspective exploded schematic view of the present invention.
Figure 4:
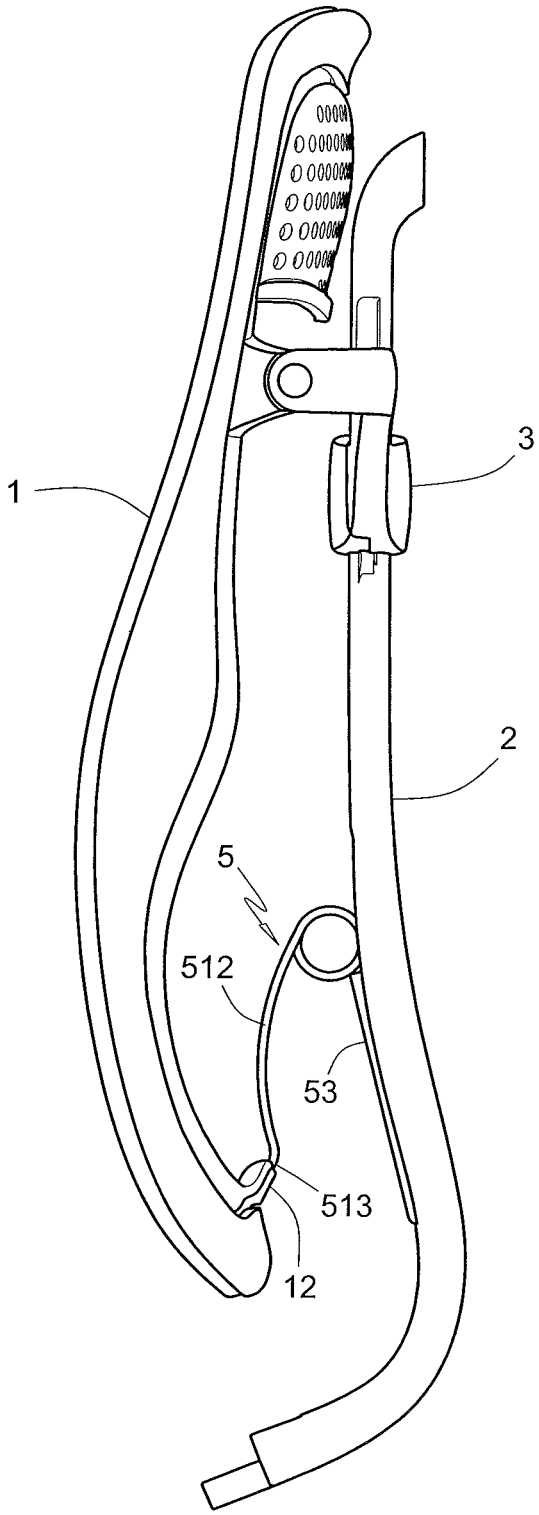
FIG. 4 is a side schematic view of the present invention.
Figure 5:
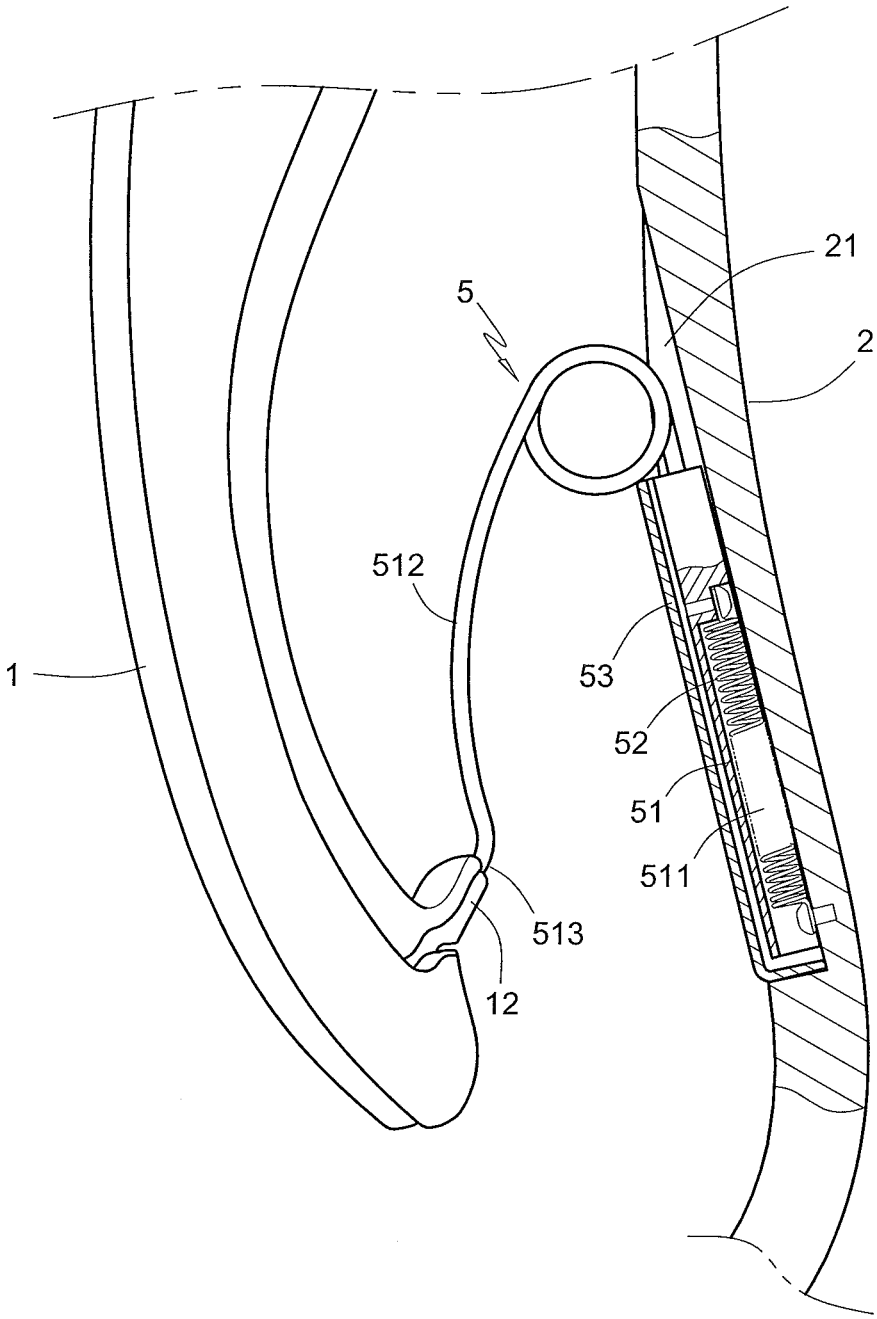
FIG. 5 is a cross-sectional view of a resilient leaning position-restoring device of the present invention.

Referring to FIG. 1, according to the present invention, a back support unit 2 is locked to a chair and equipped with a chair back 1. Two ends of a coupling support unit 3 are capable of positioning and are slidably disposed at the upper portion of the back support unit 2. The two ends of the coupling support unit 3 are pivotally coupled to two pivotal members 11 at the upper left portion and the upper right portion of the chair back 1 by pivotal elements 4, respectively. Hence, the back support unit 2 is pivotally coupled to the chair back 1. A resilient leaning position-restoring device 5 is connected between the bottom of the chair back 1 and the back support unit 2. The structure of the resilient leaning position-restoring device 5 and how the resilient leaning position-restoring device 5 is connected between the chair back 1 and the back support unit 2 are illustrated with FIGS. 2, 3 and FIGS. 4, 5 and described hereunder. A slot 21 is disposed at a lower portion of the back support unit 2. The resilient leaning position-restoring device 5 comprises a sliding element 51, a spring 52, and a lid 53. The sliding element 51 is received in the slot 21. The lid 53 covers the slot 21. Hence, the sliding element 51 is held between the slot 21 and the lid 53. A slit 511 is disposed deep in the rear of the sliding element 51. The spring 52 is received in the slit 511. The upper end of the spring 52 is fixed to an upper end of the sliding element 51. The lower end of the spring 52 is fixed to the slot 21. Hence, the spring 52 pulls the sliding element 51 downward.

The upper end of the sliding element 51 extends to form a resilient member 512 of an inverted U shape. A lower end 513 of the resilient member 512 is locked to a fixing portion 12 at a lower middle portion of the chair back 1. Hence, the resilient member 512 pushes the lower portion of the chair back 1 resiliently.

A positioning mechanism positioned between the coupling support unit 3 and the back support unit 2 is not a focus of the disclosure of the present invention and therefore is not described in detail herein. In short, the positioning mechanism operates as follows: the coupling support unit 3 can be positioned at different positions as needed in the course of the gradual ascent of the coupling support unit 3. However, once it ascends to the highest position, the coupling support unit 3 can start to slide downward freely until it lands on the lowest position.

Figure 6:
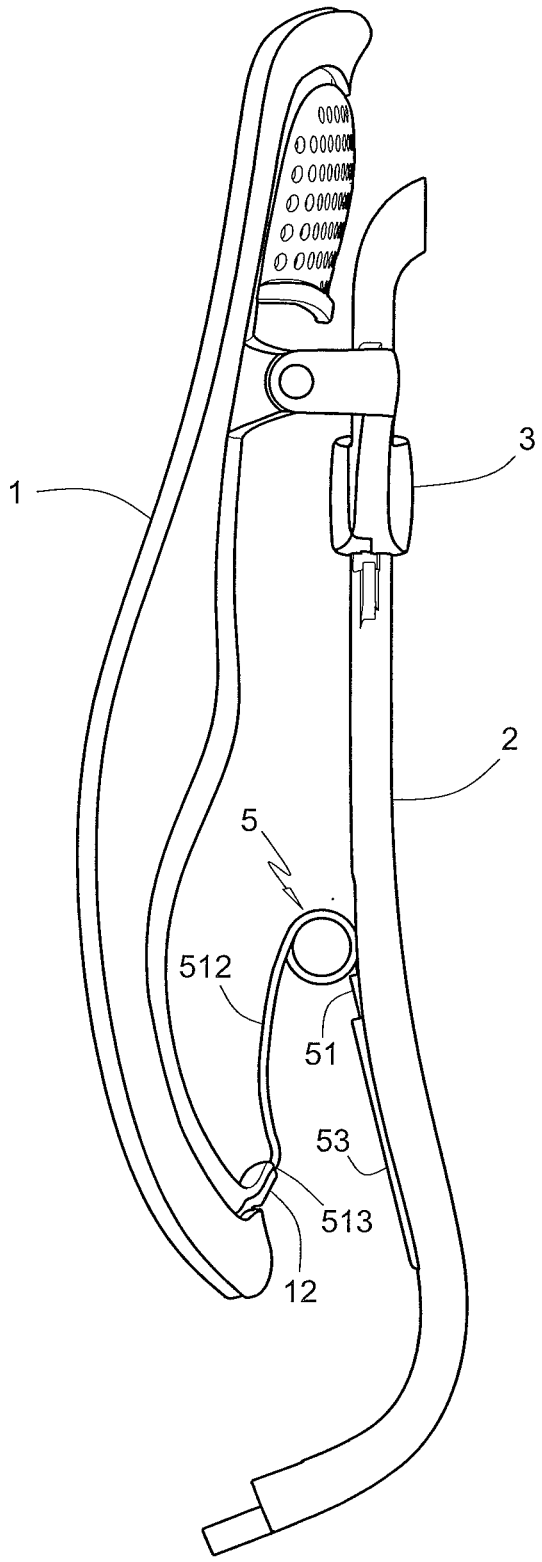
FIG. 6 is a schematic view of an upward-adjusted chair back according to the present invention.
Figure 7:
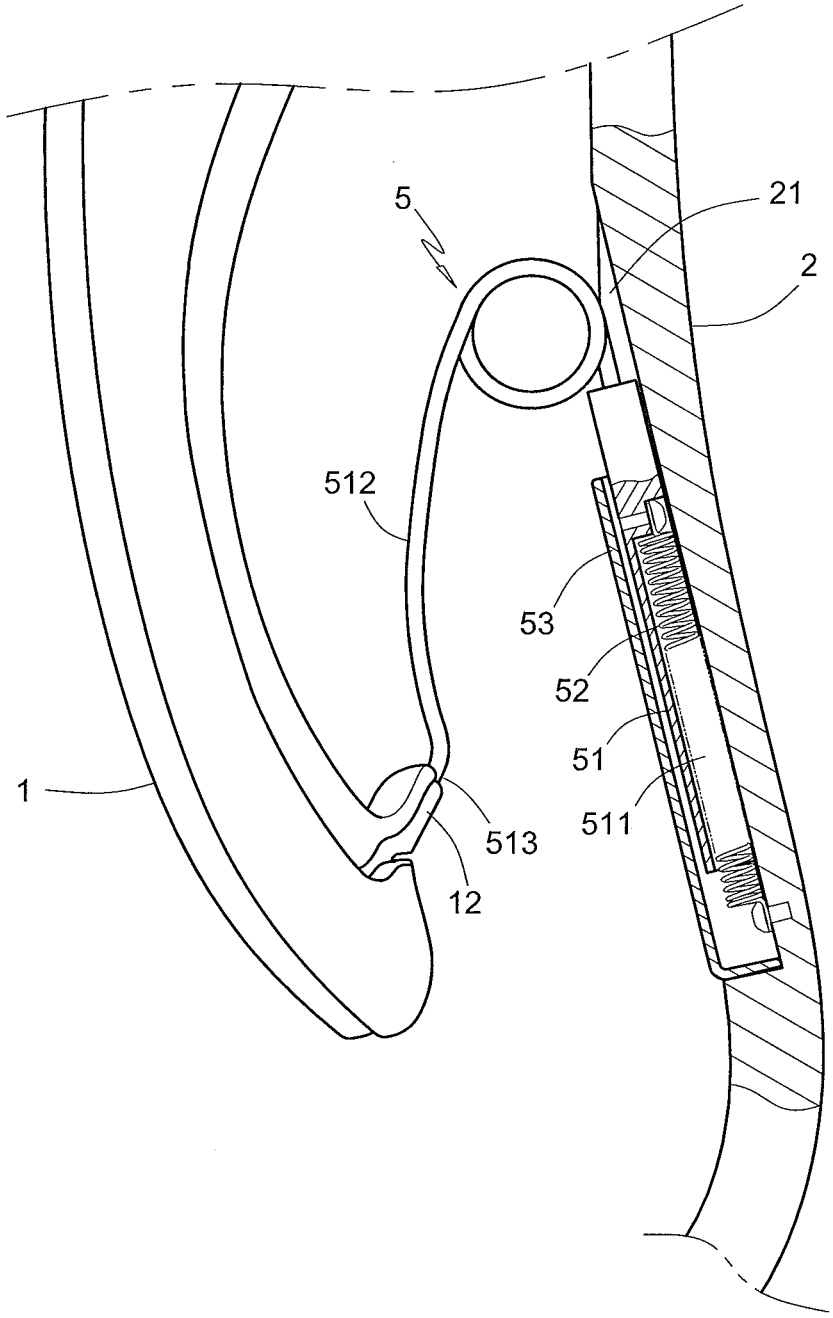
FIG. 7 is a cross-sectional view of the resilient leaning position-restoring device after the chair back has been upward adjusted according to the present invention.

Referring to FIG. 6 and FIG. 7, if the chair back 1 slides upward along the upper end of the back support unit 2 and is adjustably positioned at a predetermined height, the bottom of the chair back 1 will cause the sliding element 51 to slide upward along the slot 21 of the back support unit 2 through the resilient member 512 of the sliding element 51, and the spring 52 will pull the sliding element 51 downward such that the chair back 1 can be firmly fixed in place. Once the chair back 1 ascends to the highest position, height adjustment will take place freely. As a result, it is feasible for the spring 52 to pull the chair back 1 and thus cause the chair back 1 to return to the lowest position, thereby dispensing with a downward pull which must otherwise be given by a user. Also, the resilient member 512 always maintains the predetermined resilience thereof without being deformed, regardless of a predetermined height at which the chair back 1 is adjustably positioned. Hence, not only can the waist of a person sitting in the chair lean against the bottom of the chair back 1 firmly, but the sitter's waist can also have access to comfortable resilient support because of thorough resilience of the resilient member 512.

What is claimed is:

1. A resilient leaning position-restoring device for a height-adjustable chair back of an office chair, with the resilient leaning position-restoring device comprising a back support unit and a chair back slidably disposed at the back support unit and thus being height-adjustable, wherein the resilient leaning position-restoring device comprises a sliding element, a spring, and a resilient member, with the spring connected to a lower portion of the back support unit and to the sliding element, with the sliding element being pulled downward by the spring to slide along the back support unit, with the resilient member extended from the sliding element to form an inverted U-shape by the resilient member and the sliding element, with the resilient member forming the inverted U-shape having a first, free lower end opposite to a second, free lower end of the sliding element, with the first, free lower end coupled to a bottom of the chair back, with the first and second, free lower ends being biased to move away from each other by the resilient member.

2. The resilient leaning position-restoring device of claim 1, wherein a slot is disposed at the lower portion of the back support unit and covered with a lid, wherein the sliding element is held between the lid and the slot, wherein an upper end of the spring pulling the sliding element is fixed to an upper end of the sliding element, and wherein a lower end of the spring is fixed to the slot.

* * * * *